United States Patent [19]

Dittmar

[11] Patent Number: 4,665,735

[45] Date of Patent: May 19, 1987

[54] DEVICE FOR DETECTING METALLIC TICKING SOUNDS

[76] Inventor: Norman R. Dittmar, 525 5th Ave. N. W., Rochester, Minn. 55901

[21] Appl. No.: 804,050

[22] Filed: Dec. 2, 1985

[51] Int. Cl.[4] ..... G04B 17/00

[52] U.S. Cl. ..... 73/6

[58] Field of Search ..... 73/6, 572, 587, 593, 73/660; 307/362, 355, 308; 330/260

[56] References Cited

U.S. PATENT DOCUMENTS

| | | | |
|---|---|---|---|
| 2,544,482 | 3/1951 | Barnes | 73/6 |
| 2,561,084 | 7/1951 | Wickham et al. | 73/6 |
| 3,287,506 | 11/1966 | Hahnlein | 307/308 |
| 3,690,144 | 9/1972 | Bonny | 73/6 |
| 3,811,315 | 5/1974 | Kunitomi | 73/6 |
| 4,112,317 | 9/1978 | Everswick | 307/308 |
| 4,188,549 | 2/1980 | Dorais | 307/308 |
| 4,417,476 | 11/1983 | Knowlton | 73/660 |

OTHER PUBLICATIONS

Berlin, The Design of Operational Amplifier Circuits, with Experiments, Oct. 1977, E & L Instruments, Inc., Derby, CT., pp. 9-8 to 9-9.

*Primary Examiner*—Michael J. Tokar
*Assistant Examiner*—Robert R. Raevis

[57] ABSTRACT

An improved device for detecting ticking sounds produced from inside some mechanism, is described. The purpose of the device is to sense the ticks and produce a well defined electrical pulse for each tick while rejecting other noises and electrical interference. Previous devices for this purpose have typically employ-commercially available microphones as the sensor. The invention employs a combination of sensor and circuitry which gives improved rejection of noise, and a signal to noise ratio in excess of 10:1 under most conditions.

4 Claims, 4 Drawing Figures

DEVICE FOR DETECTING METALLIC TICKING SOUNDS

CITED REFERENCES

| | | |
|---|---|---|
| 3,690,144 | 1970 | 73/6 |
| 3,811,315 | Feb 15, 1972 | 73/6, 73/462 |
| 3,926,048 | Dec 1975 | 73/6 |
| 4,335,596 | 1979 | 73/6 |

SUMMARY OF THE INVENTION

A well defined electical pulse corresponding to an internal mechanical ticking sound is useful with regard to several types of mechanisms, noteably clock escapements in various forms of mechanical clocks. In these applications an electrical pulse for each tick is useful for measuring the period of the ticks.

The object of the present invention has been to arrive at a transducer and electronic circuit combination which result in well defined pulses, one for each tick, while rejecting ambient sound waves, bench vibrations, and induced electrical interference.

By a 'well defined' pulse is meant an electrical pulse which reaches a characteristic value consistently within a short time after the tick which caused it, and its peak emf (electromotive force) is substantially greater than that of normal background noise from all sources.

Previous watch testing instruments have utilized conventional microphones to sense the ticking sounds and then relied upon signal processing techniques to arrive at well defined pulses.

For example, U.S. Pat. No. 3,811,315 employed high pass filtering; U.S. Pat. No. 3,926,048 employed a single ended differential amplifier; U.S. Pat. No. 4,335,596 employed a type of autocorrelation filtering.

An improved sensor is described in U.S. Pat. No. 3,690,144, but this was designed to respond to angular impulses.

The present invention features (a) an acoustoelectric transducer for sensing ticks, which transducer is intrinsically immune to ambient sound waves and whose sensing element can withstand considerable steady bias force on its armature;

(b) electrical coupling network to an amplifier, which coupling improves response to the initial part of the tick;

(c) an amplifier whose circuit configuration results in attenuation of all electrical interference.

DRAWING DESCRIPTIONS

FIG. 1. Acoustoelectric Transducer Details, Front sectional View and corresponding top view.

FIG. 2. Side Sectional View of Transducer and corresponding Top View.

FIG. 3. Schematic Diagram of the Invention

FIG. 4. Electronic Waveforms in the Tick Detector Circuitry, symbolizing a single tick from a wrist watch. Ordinate is emf; abscissa is time after initial metallic contact.

DETAILED DESCRIPTION OF THE PREFERRED EMBODIMENT

Figure 3:
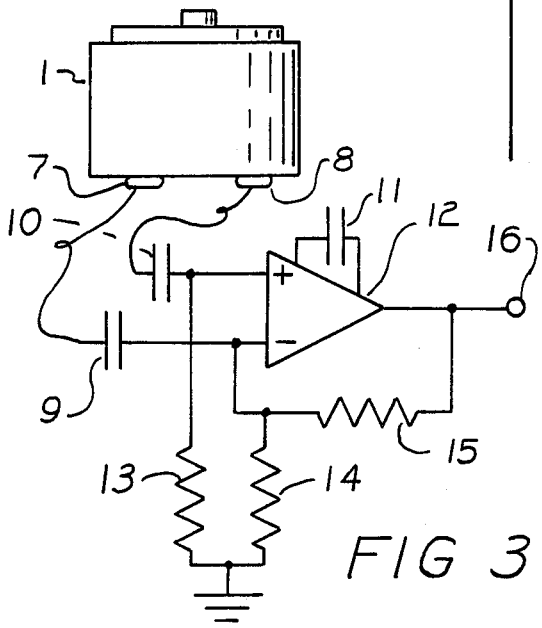

The tick detector comprises an acoustoelectic transducer 1 (including a housing) of FIG. 3, whose electrical output passes through two capacitors, 9 and 10

(whose individual capacitance values may be approximately equal) and into the two input ports of a differential input linear amplifier, 12. The operation of these components are as follows: Ticking vibrations are transmitted directly from the casing of the mechanism to be sensed, to the sensing end of the rigid vibration transmitting means, 3, an aluminum tube. The ticking vibrations are produced by metal on metal contact within the casing (housing) of the mechanism. The said aluminum tube is affixed to the armature of said transducer, a piezoelectric microphone cartridge, which has had the diaphragm removed.

The sensing end 3 of said aluminum tube extends above the surface of the shroud 5 enough to allow the said sensing to be contacted. The shroud 5, here in the form of a washer, prevents spurious ambient sounds from reaching the piezoelectric element, 6. The said washer also provides a point for support for small mechanisms to rest partly on it and partly on said sensing end.

Figure 1:
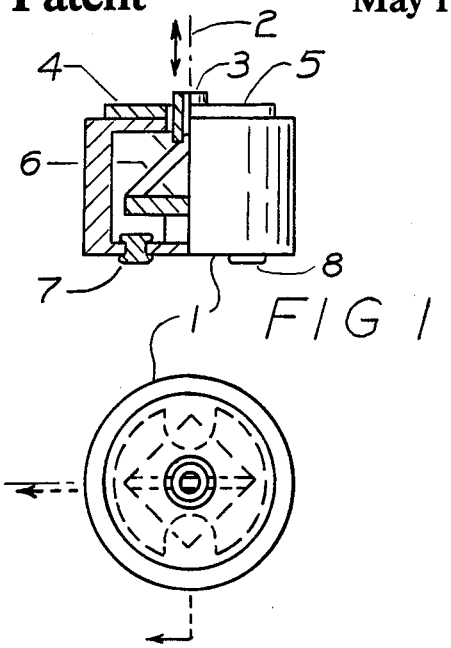
Figure 2:
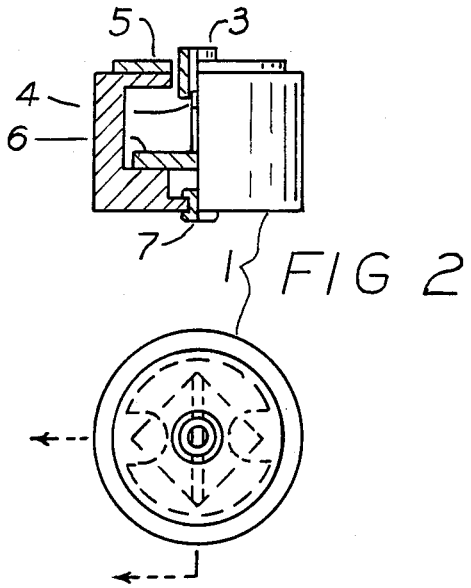

Said transducer is illustrated in FIGS. 1 (front sectional view) and 2 (side sectional view). The said aluminum tube is cemented to the armature 4, which in turn transmits vibrations to the piezoelectric element 6. The electrical connections to the said element are brought out through terminals 7 and 8. The axis of motion 2 of said armature passes as shown.

The capacitors 9 and 10 of FIG. 3, are chosen such that their combined capacitance in series is small enough that the time constant of the combination of said capacitors and the sum of the input resistances (13 and 14) (whose individual resistance values may be approximately equal) is less than the shortest period of vibration anticipated at said transducer. This criterion ensures amplifier emf to be proportional essentially to the rate of change of the armature vibrations. The advantage over previous level sensitive or frequency selective circuits lies in the fact that the initial part of any tick caused by the contact of two metal members tends to give the fastest rate of armature motion at the instant of said contact.

Figure 4:
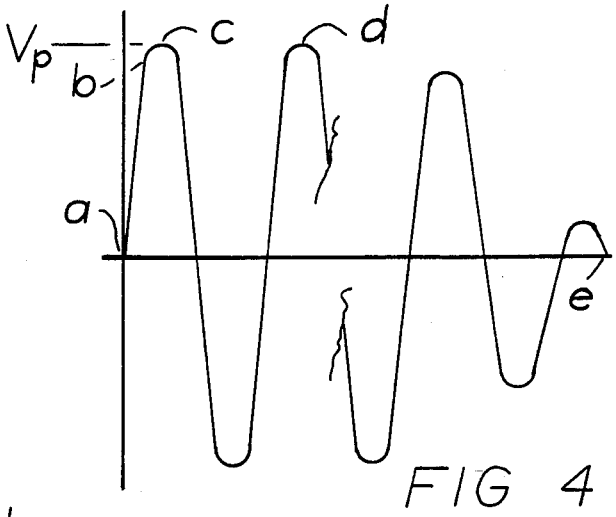

The waveform at the device output terminal 16 due to a single tick from inside the mechanism being sensed, is symbolized by FIG. 4. The ordinate in FIG. 4 is emf; the abscissa is time, on the order of several milliseconds, after the initial contact of metallic members causing the tick. The relatively large emf from a to b at time zero constitutes a prominent feature in that waveform. The peak amplitude, $V_p$, of FIG. 4 exceeds four volts for a typical wrist watch, enough to drive commercially available counters, triggers, and the like. Point b is the point at which the voltage reaches 90% of the voltage $V_p$ of the first peak c. The time from point a to point b may be six microseconds; the time from point c to point d may be 35 microseconds. The time from point a to point e may be two milliseconds, at which time the device output has returned to zero.

A further advantage of the said device is that the smallest watch escapements tend to generate said peak amplitude ($V_p$ in FIG. 4) which is nearly as large as that of larger escapements, thus obviating the need for gain control.

Because it is generally the initial part of each tick which causes the said most prominent part of said amplifier output, variations in measuring the time between two ticks are relatively small, resulting in acceptably low error in such measurements without further signal processing, in a watch (time piece) calibrator for example.

The capacitor 11 in FIG. 3 represents the equalization capacitor for the said amplifier, which is a bipolar integrated circuit operational amplifier; the resistor 15 is in resistance approximately 700 times that of said input resistor (13 or 14) value, which is approx. 15,000 Ohms.

I claim:

1. A system for detecting ticking sounds produced by metal on metal contact within the housing of a mechanism, said system comprising:

(a) an acoustoelectric transducer including a second housing containing a rigid transmitting means for transmitting vibration from a sensing end of the rigid transmitting means extending outside the second housing to an armature positioned adjacent a piezoelectric element, whereby ticking sounds produced within the housing of the mechanism in contact with the sensing end of said rigid transmitting means result in vibration of both the rigid transmitting means and armature, causing the piezoelectric element to produce a corresponding emf across first and second output terminals of said piezoelectric element;

(b) a first capacitor electrically coupled between said first output terminal and a first input of a differential input linear amplifier;

(c) a second capacitor electrically coupled between the second output terminal and a second input of the differential input linear amplifier, wherein the individual capacitance values of said first and second capacitors are approximately equal;

(d) a first resistor electrically coupled between the first input of the differential input linear amplifier and device ground;

(e) a second resistor electrically coupled between the second input of the differential input linear amplifier and device ground, wherein the individual resistance values of said first and second resistances are approximately equal and are less than one half of the differential input resistance of said differential input linear amplifier; and (f) an output terminal of said differential input linear amplifier that transmits an output emf, wherein the capacitance values of the first and second capacitors are chosen such that the time constant of the series combination of said first and second capacitors and the sum of the first and second resistance values is less than the shortest period of vibration anticipated such that the output emf is proportional to the rate of change of the vibrations, whereby the initial part of any ticking sound creates a peak voltage at the output terminal because the initial part of any ticking sound tends to give the greatest rate of change of vibrations.

2. The system of claim 1, wherein said rigid transmitting means is aligned so that the sensing end is intersected by the axis of motion of said armature.

3. The system of claim 1, wherein the mechanism comprises a time piece that may be positioned with all or part of its weight on said sensing end.

4. The system of claim 1, wherein the system is utilized in the calibration of a time piece.

* * * * *